US005237937A

United States Patent [19]

Peltier et al.

[11] Patent Number: 5,237,937

[45] Date of Patent: Aug. 24, 1993

[54] EXPANSIBLE TABLE

[76] Inventors: Jacques Peltier; Joan Tanin, both of 2320 Avenue V, Brooklyn, N.Y. 11229

[21] Appl. No.: 860,769

[22] Filed: Mar. 26, 1992

[51] Int. Cl.[5] ..... A47B 1/00

[52] U.S. Cl. ..... 108/66; 108/83

[58] Field of Search ..... 108/65, 66, 83, 87, 108/89

[56] References Cited

U.S. PATENT DOCUMENTS

| | | | |
|---|---|---|---|
| 20,530 | 6/1858 | Pratt . | |
| 36,496 | 9/1962 | Mets . | |
| 46,240 | 2/1865 | Iske | 108/83 |
| 56,632 | 7/1866 | Stout | 108/83 |
| 355,817 | 1/1887 | Grube . | |
| 606,084 | 6/1898 | Poupon | 108/64 |
| 687,712 | 12/1901 | D'apery | 108/83 |
| 722,577 | 3/1903 | Gregory | 108/83 |
| 745,115 | 11/1903 | Petersen | 108/65 |
| 1,320,215 | 10/1919 | Field | 108/64 |
| 1,392,527 | 10/1921 | Santoro | 108/64 |
| 1,547,685 | 7/1925 | Rhodes . | |
| 1,854,129 | 4/1932 | Folsom | 108/64 |
| 2,110,068 | 3/1939 | Kowalski | 108/11 |
| 2,492,139 | 12/1949 | Eliason | 108/83 |
| 4,259,909 | 4/1981 | Belina | 108/12 |
| 4,282,817 | 8/1981 | Gutterman | 108/11 |
| 4,303,018 | 12/1981 | Lehmann | 108/12 |
| 4,583,467 | 4/1986 | Tiffany . | |

FOREIGN PATENT DOCUMENTS

| | | | |
|---|---|---|---|
| 3636169 | 4/1988 | Fed. Rep. of Germany | 108/62 |
| 0006788 | 3/1985 | United Kingdom | 108/66 |

*Primary Examiner*—Kenneth J. Dorner
*Assistant Examiner*—Gerald A. Anderson

[57] ABSTRACT

An expansible table includes a round tabletop formed of four equal sectors or quadrants for sliding movements on tracks between retracted and extended positions which permits the insertion of inserts or leaves to enlarge the size of the table. Guide pins downwardly extending from each sector are captured in associated spiral slots of a rotatably mounted platform or plate, so that rotation of the slotted plate facilitates simultaneous movement of all the sectors to the desired positions. Such expansion and contraction of the table can be accomplished by one individual in an effortless and a convenient manner.

18 Claims, 5 Drawing Sheets

Fig. 2
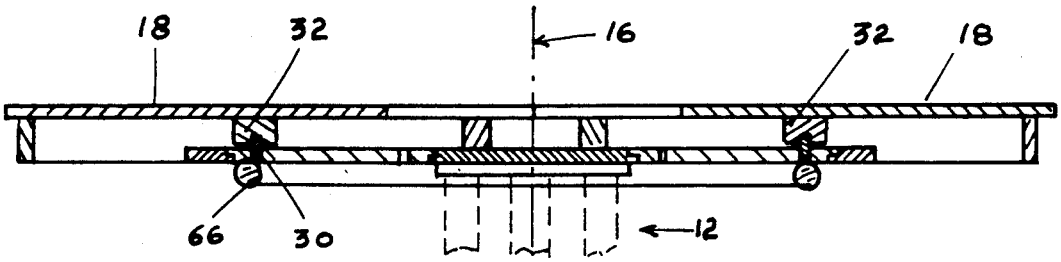
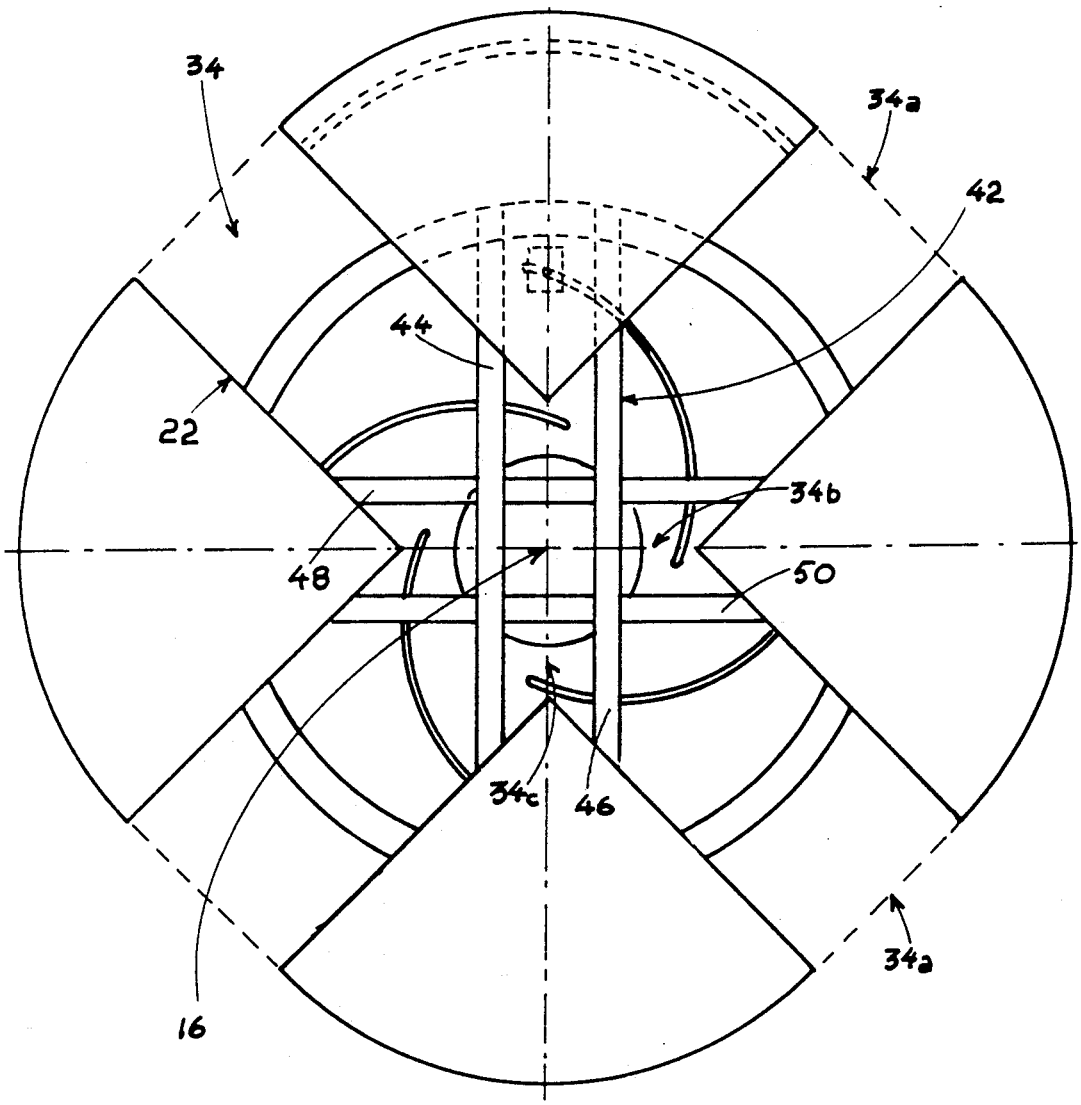
Fig. 3

EXPANSIBLE TABLE

BACKGROUND OF THE INVENTION

1. Field Of The Invention

The invention generally relates to tables, and more specifically, to expansible tables which have a number of sectors and an actuating member which simultaneously moves all the sectors between retracted and extended positions to facilitate insertion and removal of inserts or leaves.

2. Description Of The Prior Art

Expansible tables have been known for many years. While the simpler constructions usually involve rectangular tables, it has also been known to extend or convert circular tables from smaller to larger tabletops. Patents which exemplify typical constructions include U.S. Pat. Nos. 20,530; 36,496; 46,240; 56,632; 1,320,215; 1,854,129; and 4,583,467.

Round tables are typically formed of four equal sectors or quadrants, as illustrated in U.S. Pat. Nos. 355,817; 687,712; 722,577; 745,115; and 1,547,685. The '817 patent discloses built-in leaves or inserts, while the '712 patent discloses a square table. The '685 patent discloses the use of two long inserts or sleeves which superimpose one upon the other in the center of the table. Short sleeves or inserts are disclosed in the '712 and '577 patents.

Other round tables are disclosed in U.S. Pat. Nos. 606,084; 745,115; 1,392,527; 2,492,139; 4,259,909; and 4,303,018. The '115 patent discloses numerous sections or leaves, while the '909 patent discloses a table which can be converted from a low coffee table to a higher standing dining table. The '139 patent shows a section of an expansible circular table provided with curved grooves intended to receive vertical pins connected to braces for engagement in the curved grooves.

None of the aforementioned patents, however, disclose a simple mechanism for simultaneously moving quadrants or sectors radially outwardly or returning them towards the center of the table in an easy and convenient manner.

SUMMARY OF THE INVENTION

Accordingly, it is an object of the invention to provide an expansible table which does not have the disadvantages inherent in prior art tables of this type.

It is another object of the invention to provide an expansible table which is simple in construction and economical to manufacture.

It is still another object of the invention to provide an expansible table of the type aforementioned which is convenient and simple to use, allowing quick expansion and retraction of a tabletop.

It is yet another object of the invention to provide an expansible table which requires minimum effort and strength to convert the table from one to another tabletop surface.

It is a further object of the invention to provide an expansible table which can be converted by one person and even by one hand.

In order to achieve the above objects and others which will become evident hereafter the expansible table in accordance with the invention comprises a base. A tabletop is provided which consists of a plurality of separable sectors generally arranged about a central point and together form a first tabletop surface when said sectors are in retracted first positions closest to said central point and at least adjacent ones of said sectors abut against each other. Support means are provided for movably supporting said sectors on said base for movement within the plane of said tabletop between said retracted first position and an extended second position more remote from said central point to create spaces between at least adjoining sectors having predetermined configurations. Inserts are provided having said predetermined configurations to be received within associated spaces to thereby fill said spaces and provide, with said sectors, a second tabletop surface defining an area greater than the area of said first tabletop surface. Actuating means is provided for simultaneously moving all said sectors between said retracted first and extended second positions. In this manner, movement of said actuation means facilitates insertion and removal of said inserts and conversion of the areas of said tabletop between said first and second tabletop surfaces

BRIEF DESCRIPTION OF THE DRAWINGS

The invention will become more fully understood from the detailed description given herein below of a presently preferred embodiment, and the accompanying drawings are given by way of illustration only, and thus are not limiting of the invention, and wherein:

FIG. 2 is a transverse cross-sectional view of the upper part of the shown in FIG. 1, taken along line 2—2;

FIG. 3 is a top plan view of the tabletop shown in FIG. 2, illustrating the leave or insert-receiving spaces formed between adjacent sectors when the same are moved outwardly to their extended positions, and showing the mechanism for simultaneously the sectors to their extended positions;

DESCRIPTION OF THE PREFERRED EMBODIMENTS

Figure 1:
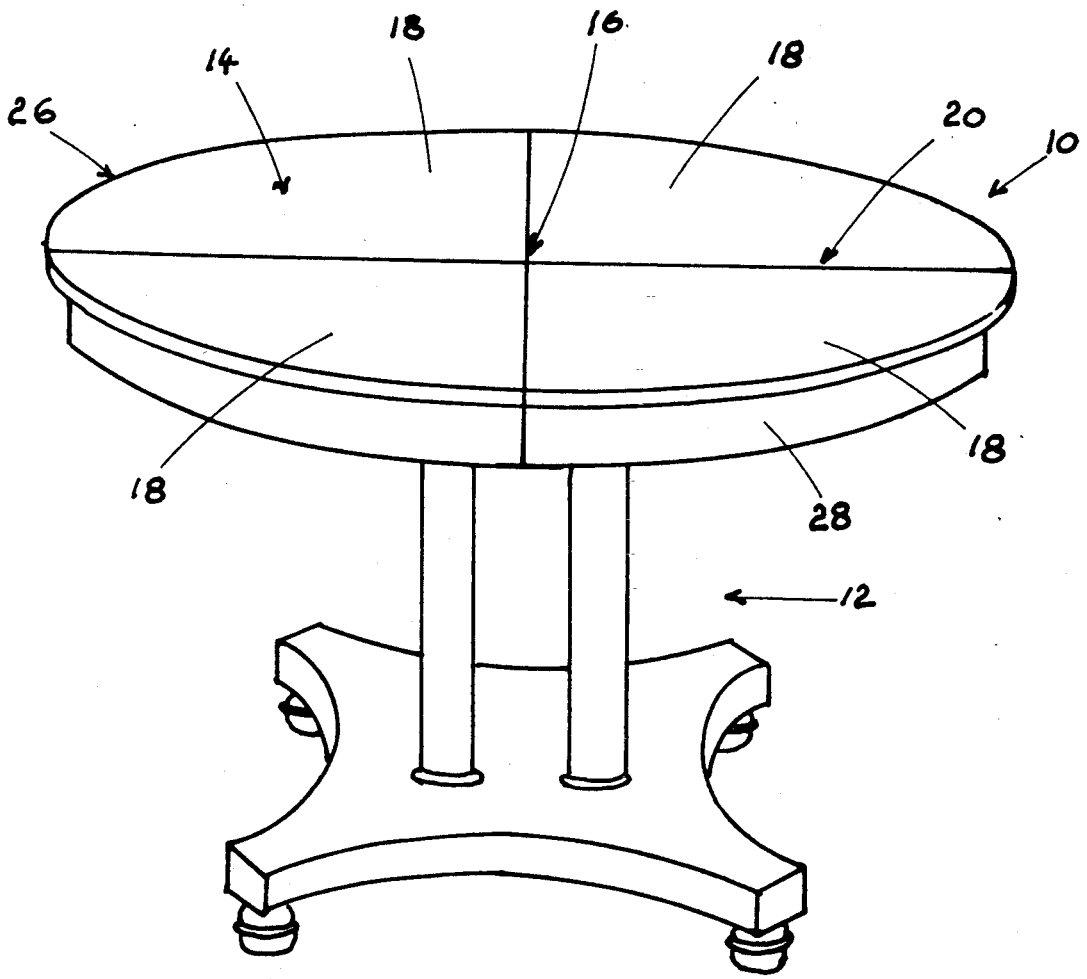
FIG. 1 is a perspective view of an expansible table in accordance with the present invention, showing the table in its retracted position to provide a smaller round tabletop surface.
Figure 4:
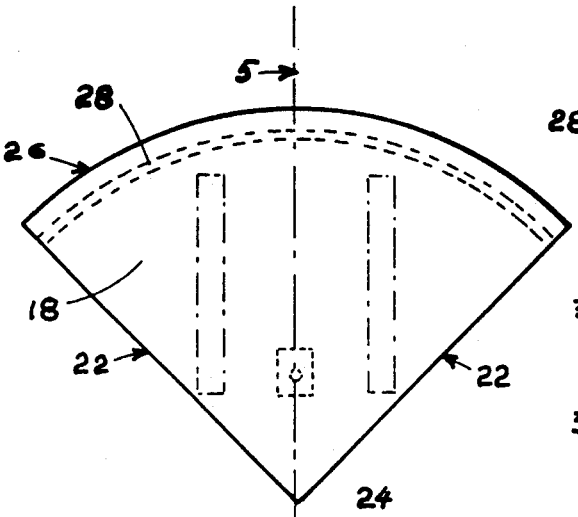
FIG. 4 is a top plan view of a single sector forming the tabletop.
Figure 5:
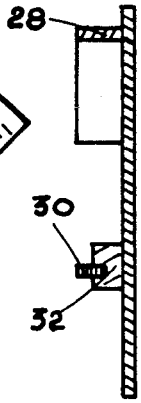
FIG. 5 is a side view of the sector shown in FIG. 4.

Referring now more specifically to the drawings, where the identical or similar parts are identified by the same reference numerals throughout, and first referring to FIG. 1, an extensible table in accordance with the invention is generally designated by the reference numeral 10.

The table 10 includes a base 12, shown as a pedestal. A horizontal tabletop, generally designated by the reference numeral 14, has a central point 16 which defines a vertical axis in relation to which a plurality of separable sectors 18 move, as will be more fully described. In the embodiment shown, the tabletop is a circular one and the sectors 18 are equal quadrants defined by two substantially orthogonal parting lines 20 which intersect through the central point 16. In the condition shown in FIG. 1, the sectors 18 together form a first tabletop surface when the sectors are in retracted positions closest to the central point 16, and at least adjacent ones of the sectors abut against each other, as shown.

Also referring to FIGS. 2–5, each sector 18 has two radial edges 22 defining an angle of 90° which meet at point 24, and a circular chord 26 forming a portion of the circular edge or periphery of the tabletop. A downwardly depending skirt 28 may be provided but is not necessary or critical to the invention. For reasons to be more fully described, the underside of the sectors 18 is provided with a downwardly extending guide pin 30 which is offset from the plane of the sector 18 by a spacer block 32.

Referring particularly to FIGS. 2 and 3, the sectors 18 are movably mounted, as will be more specifically described below, on the base 12 for movement within the plane of the tabletop 14 between the retracted first position shown in FIG. 1 and an extended second position more remote from the central point or vertical axis 16 to create spaces 34 between at least adjacent sectors 18. The spaces 34 will have different predetermined configurations depending on the shape of the tabletop, the number of and shapes of the sectors 18. In the embodiment being described, where the tabletop is formed of four equal sectors or quadrants, four identical spaces 34 are formed each defined by dashed lines **34*a*, 34*b* and 34*c***.

Figure 6:
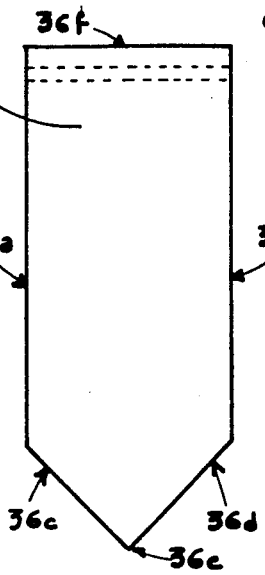
FIG. 6 is a top plan view of a leave or insert configurated to be received within the spaces shown in FIG. 3.
Figure 7:
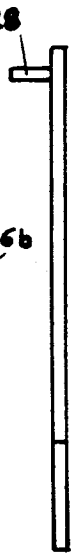
FIG. 7 is a side view of the insert shown in FIG. 6.

Referring to FIGS. 6 and 7, an insert or leaf 36 is shown which is configurated to fit and be received within a space 34, the edges **36*a*, 36*b* of the insert being parallel to each other and equal in length to the radial edges 22 of the sectors so that these can abut against each other. The edges 36*c*, 36*d* being inclined towards each other as shown to meet at a point or vertex 36*e*, these edges forming an angle of 90° with each other. The length of the insert 36 being selected so that the outer edge 36*f* of the insert coincides with the line 34*a* of the resulting space 34 so that the edge 36*f* will form a substantially continuous outer edge or periphery of the tabletop in its extended or expanded condition. Similarly, the insert is provided with a skirt 28' which is arranged to align with the skirts 28 on two spaced adjacent sectors 18** to provide a substantially continuous skirt in the extended or expanded condition of the table. In the extended position of the table, with the inserts in place, a second tabletop surface is formed which defines an area greater than the area of the initial tabletop surface when the table is closed or retracted.

Figure 9:
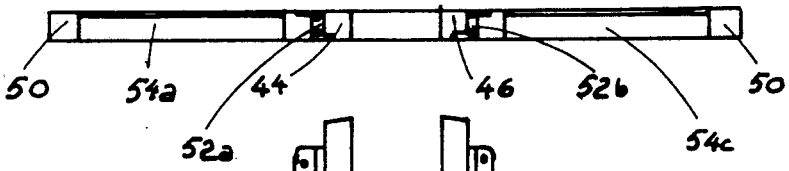
FIG. 9 is a front elevational view of the support tracks shown in FIG. 8.
Figure 8:
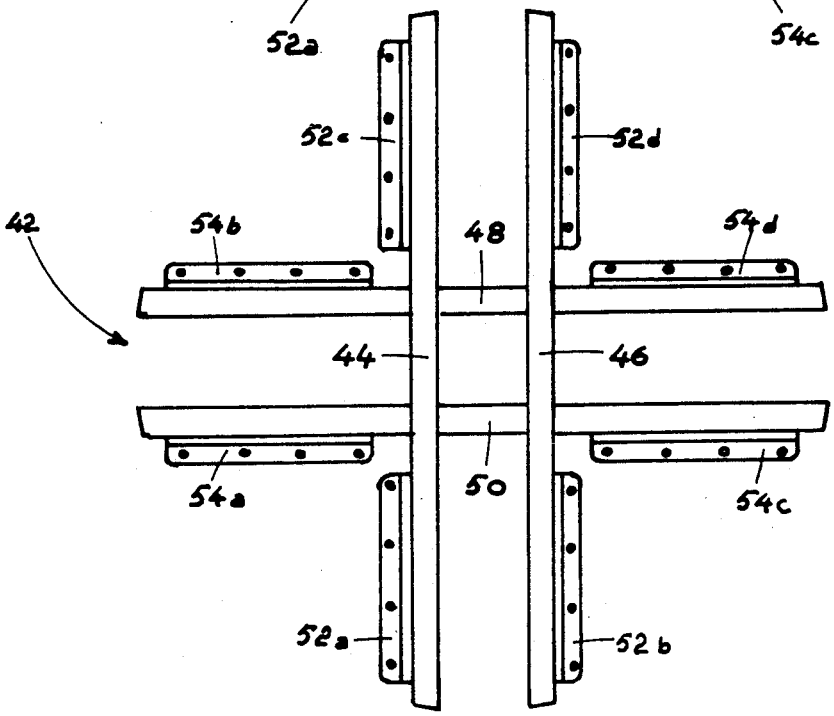
FIG. 8 is a top plan view of the support tracks which slidably support the sectors.

One feature of the invention is the provision of supporting means, generally identified by the reference numeral 42 in FIGS. 3, 8 and 9, for movably supporting the sectors 18 between the retracted and extended positions. The supporting means 42 is in the form of racks 44, 46, 48 and 50 mounted on the base 12 and sliding members **52*a*–52*d* slidably mounted on the tracks 44, 46 and sliding members 54*a*–54*d* mounted on the tracks 48, 50 as shown. Advantageously, the sliding members are mounted on bearings for reducing friction when the sliding members slide on the tracks As best shown in FIG. 3, each sector 18** is fastened to as associated pair of sliding members to fix the sectors within the tabletop plane while permitting slidable movements within that plane. Any conventional means may be used to attach each sector to its associated sliding members, such as wood screws. Although one track can be used for each sector, the use of spaced parallel tracks as shown improves the stability of the sectors both during movement and during use of the table and helps to assure that the sectors will properly align with each other.

In the embodiment shown, the tracks 44, 46, on the one hand, and the tracks 48, 50, on the other hand, are arranged along orthogonal directions and angularly offset from the parting lines 20 and radial edges 22 by 45°. Each pair of tracks 44, and 48, 50 supports two sectors on diagonally opposite sides of the central point 16.

While in the embodiment being described there are four identical sectors or quadrants, it will become evident to those skilled in the art that any number of n sectors, where $n \geqq 2$, can be used, in which case n tracks or n pairs of spaced parallel tracks can be provided angularly spaced about and arranged along radial directions in relation to the central point 16. As with the four sector embodiment, at least adjacent sectors of the n sectors will abut against each other in the retracted position and move radially outwardly from the center or central point 16 to the extended second position. Where the sectors are all equal or identical the inserts will all be similarly configurated. This will not necessarily be true if the sectors are not identical or irregular, as will be described in connection with FIGS. 14 and 15.

Figure 11:
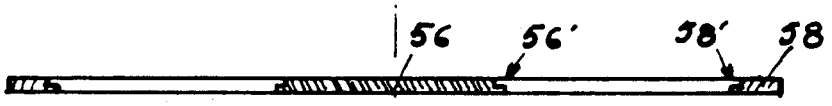
FIG. 11 is a side elevational view of the members shown in FIG. 10.
Figure 10:
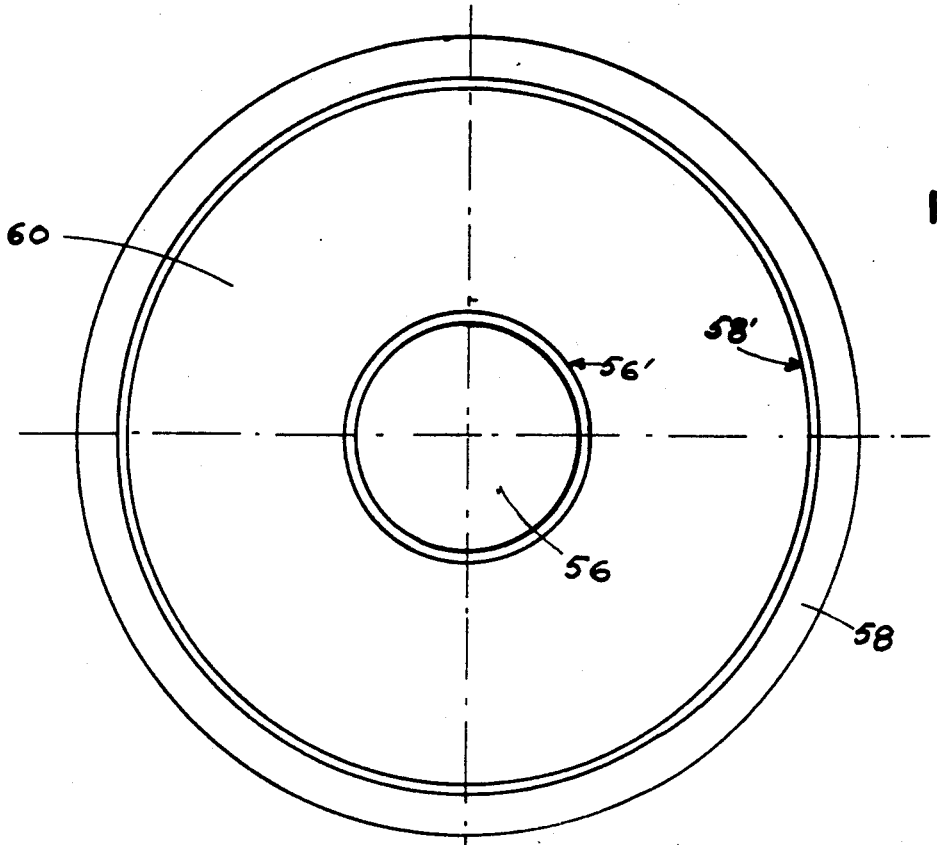
FIG. 10 is a top plan view of central disc and annular ring which fix the position of the support tracks relative to base of the table.

Referring to FIGS. 2, 10 and 11, the tracks 44, 46, 48 and 50 are supported and fastened in any conventional way to a central circular plate or disc 56 which is itself supported and attached in any conventional way to the base 12, so that the disc or plate 56 is maintained stationary in relation to the base 12 and the ground. A concentric annular ring 58 is secured in any conventional way to the outer ends of the tracks, as shown in FIG. 2, so that the ring 58, as well, is also maintained stationary to the base 12 and the ground. In FIGS. 2 and 11, both the disc or plate 56 and the annular ring 58 include upwardly facing circular support surfaces 56' and 58', respectively, which define and bound an annular intermediate region 60.

Figure 13:
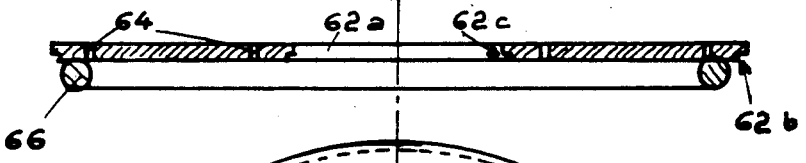
FIG. 13 is a side elevational view of the platform shown in FIG. 12.
Figure 12:
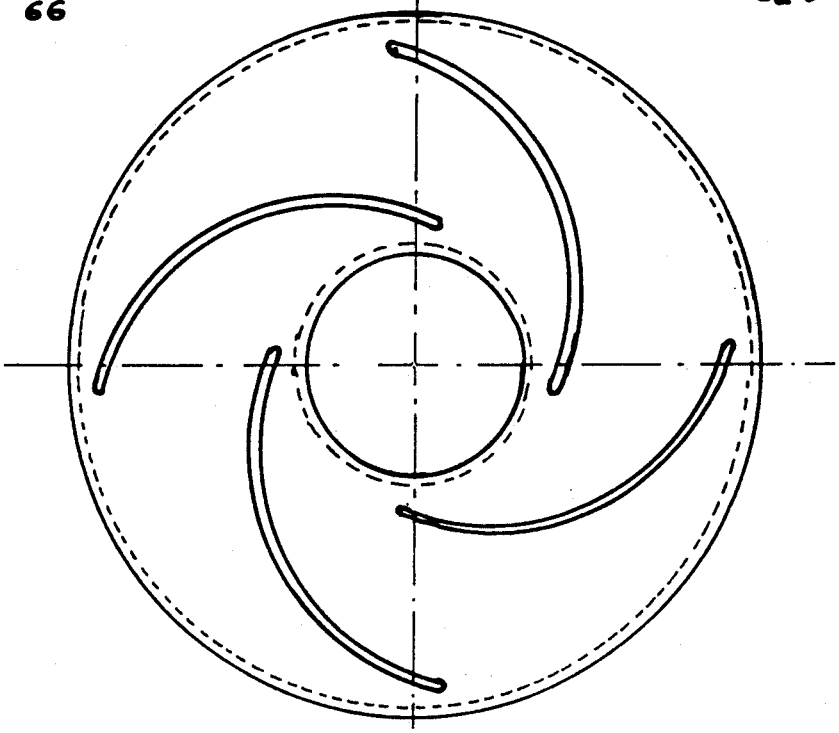
FIG. 12 is a top plan view of the actuatable slotted platform which receives the guide pins on the sectors.
Figure 14A:
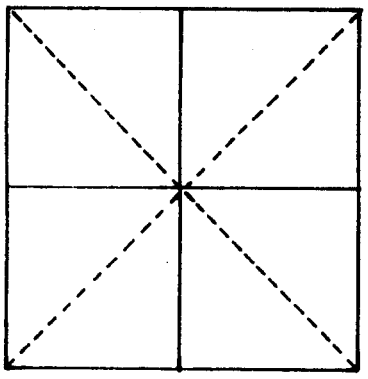
FIGS. 14A–14D illustrate further possible embodiments which have differently shaped sectors.
Figure 14B:
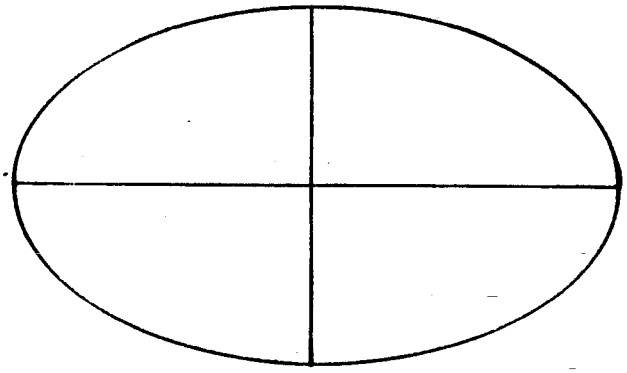
Figure 14C:
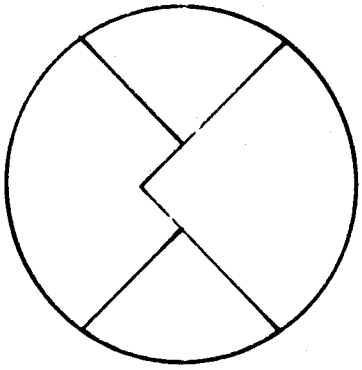
Figure 14D:
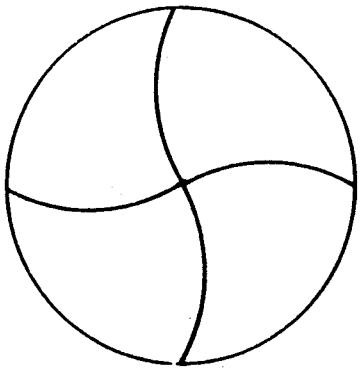

An important feature of the invention is the provision of actuating means, best shown in FIGS. 12, 13 and generally designated by the reference numeral 62, for simultaneously moving all of the sectors between the retracted first and extended second positions, so that movement of the actuation means facilitates insertion and removal of the inserts and the conversion of the areas of the tabletop between the first and second tabletop surfaces. In the present embodiment, the actuating means is in the form of a circular platform 62 mounted for rotation about the central point 16. This is achieved by providing a central opening or hole **64*a* in the platform, and providing downwardly facing circular support surfaces 64*b* and 64*c* about the respective peripheries of the outer and inner edges of the platform and the hole 64*a*. The diameters and dimensions of the support surfaces 56', 58' and the support surfaces 64*b*, 64*c* are selected so that the platform can be placed on the disc 56 and ring 58 and associated support surfaces slidably abut against each other. The mating support surfaces are preferably provided with smooth finishes, lubricated or otherwise mounted to minimize friction when the platform 62 rests on and rotates in relation to the disc 56, ring 58 and the base 12**.

The details of the platform 62 are best illustrated in FIGS. 2, 3, 12 and 13. The actuating means includes first guide means on each of the sectors 18, namely the pins 30, and second guide means on the platform 62 which cooperate with the pins to simultaneously move all the sectors as above suggested. In the instant embodiment, the second guide means are in the form of at least one arcuate slot in the platform for each sector which extends between positions more proximate to and remote from the center of the table at the central point. As best shown in FIGS. 3 and 12, the arcuate slots are each in the form of a section of a spiral flaring about the central point. Thus, for each sector 18 at least one spiral slot is provided which has proximate inner ends 66*a*and outer or remote ends 66*b*. Where n sectors are provided, n spiral slots are used one for each sector, all the spiral slots 64 flaring outwardly in the same sense and being equally angularly spaced from each other about the central point 16. The pins 30 are received with clearance within the slots 64 so that they may be received therein for free sliding meovement.

Advantageously, there is further provided gripping means to facilitate gripping and rotating the actuating member or platform 62 in relation to the the base 12. The gripping means is best shown in FIGS. 2 and 13, wherein it is attached to the undersurface of the actuating member 62 and is in the form of a circular hoop or rod having a circular cross section. Any other gripping member can, however, be used.

In order to preserve the aesthetic appearance of the table, the adjustment and moving elements of the table are maintained concealed and out of view. Thus, the diameter of the platform or circular plate 62 is smaller than the diameter of the tabletop in the retracted first position or condition.

In operation, referring to FIGS. 2 and 3, when the tabletop is assembled and the sectors 18 are mounted on the sliding members 52*a*–52*d* and 54*a*–54*d*, with the guide pins extending into the guide slots 64, seizing the gripping member 66 and rotating the same in a clockwise direction about the central point of the table (as viewed in FIG. 3) causes all the guide pins 30 to move radially outwardly and, consequently, to likewise cause all the sectors to move outwardly to extended positions remote from the central point. Conversely, rotation of the gripping member in a counter-clockwise direction returns all the sectors to their retracted innermost positions wherein they abut against each other as illustrated in FIG. 1.

It will be appreciated that the actuating member or plate can be provided with an appropriate number of guide grooves and the positions and shapes of such grooves or slots can govern numerous rules of action, so that the invention can also be used to simultaneously open and close square or rectangular tables, as well as tables which have any number of sectors in excess of two.

Also, the sectors need not be identical or of regular shape. Referring to FIGS. 14A–14D, different tabletop configurations are suggested, including square and round. Additionally, the sectors are shown to be somewhat propeller-shaped in FIG. 14D, while they are irregularly and differently shaped in FIG. 14C. As will be noted, the only limitation on the shapes of the sectors is that they cannot limit or interfere with their movements as above described in response to rotations of the actuating plate or platform 62.

The present invention has been described in detail for purposes of illustration only and is not to be limited by that description or otherwise except as defined in the appended claims.

We claim:

1. An expansible table comprising a base; a tabletop consisting of a plurality of separable sectors generally arranged about a central point and forming a first tabletop surface when said sectors are each in a retracted first position close to said central point, and at least adjacent ones of said sectors abut against each other; supporting means for movably supporting said sectors for movement within a plane defined by said tabletop between said retracted first position and an extended second position more remote from said central point to create spaces between at least adjoining sectors; inserts received within said spaces to provide a second tabletop surface defining an area greater than the area of said first tabletop surface; and actuating means for simultaneously moving all said sectors between said retracted first and extended second positions, whereby movement of said actuation means facilitates insertion and removal of said inserts and conversion of said tabletop between said first and second tabletop surfaces, said actuating means comprising a platform mounted for rotation about said central point, a first guide means on each of said sectors and a second guide means which cooperates with each of said first guide means said second guide means comprising at least one arcuate slot in said platform for each said sector which extends between said first and second positions, and said first guide means comprises a guide pin on each of said sectors slidably received within an associated at least one arcuate slot, whereby rotary movement of said platform causes all said guide pins to simultaneously move within said arcuate slots thereby causing all said sectors to move on said support means in a direction determined by the direction of rotation of said platform relative to said support means on which said sectors are slidably mounted.

2. A table as defined in claim 1, wherein said tabletop is in a substantially horizontal plane, and said central point is a substantially vertical axis.

3. A table as defined in claim 1, wherein said base comprises a pedestal carrying said supporting means.

4. A table as defined in claim 1, wherein said tabletop is circular, and said separable sectors are sectors defined by radial edges extending through the center of the tabletop.

5. A table as defined in claim 4, wherein four substantially equal sectors are provided which are defined by two substantially orthogonal parting lines.

6. A table as defined in claim 1, wherein said supporting means comprises track means for slidably supporting said sectors.

7. A table as defined in claim 6, wherein said track means comprises tracks mounted on said base and sliding members on said tracks connected to said sectors.

8. A table as defined in claim 7, wherein said tabletop is circular and has four substantially equal sectors defined by two substantially orthogonal parting lines passing through the center of the tabletop in the retracted position thereof when adjacent sectors substantially abut against each other, at least one track being arranged along one of two orthogonal directions for slidably supporting two sectors on opposite sides of said control point.

9. A table as defined in claim 8, wherein said tracks are angularly offset from said parting lines by 45°.

10. A table as defined in claim 8, wherein a pair of spaced parallel tracks are provided for supporting said sectors.

11. A table as defined in claim 7, wherein said tabletop is formed of n sectors, and n tracks being provided angularly spaced about and arranged along radial directions in relation to said center point, whereby at least adjacent sectors abut against each other in said retracted first position and move radially outwardly from said center point to said extended second position.

12. A table as defined in claim 11, wherein said n sectors are identical, and said inserts are similarly configurated.

13. A table as defined in claim 1, wherein said platform is in the form of a circular plate mounted below said support means.

14. A table as defined in claim 13, further comprising gripping means on said circular plate to facilitate gripping thereof to rotate said plate relative to said base and support means.

15. A table as defined in claim 13, wherein said tabletop in said retracted first position is circular, and said circular plate has a diameter smaller than said tabletop in said retracted first position.

16. A table as defined in claim 1, wherein said arcuate slots are each in the form of a section of a spiral about said central point.

17. A table as defined in claim 16, wherein n sectors are provided, and n spiral slots are provided one for each sector, all said spiral slots flaring outwardly in the same sense and being equally angularly spaced from each other about said central point.

18. A table as defined in claim 1, wherein said support means includes bearings for reducing friction during slidable movements of said sectors.

* * * * *